US008172315B2

(12) United States Patent
Jonsen et al.

(10) Patent No.: US 8,172,315 B2
(45) Date of Patent: May 8, 2012

(54) DEVICE FOR A RECLINING CHAIR

(75) Inventors: Rune Jonsen, Ålesund (NO); Lars Inge Jakobsen, Ørskog (NO)

(73) Assignee: Mobel Design AS, Orskog (NO)

( * ) Notice: Subject to any disclaimer, the term of this patent is extended or adjusted under 35 U.S.C. 154(b) by 70 days.

(21) Appl. No.: 12/682,752

(22) PCT Filed: Oct. 9, 2008

(86) PCT No.: PCT/NO2008/000358

§ 371 (c)(1),
(2), (4) Date: May 7, 2010

(87) PCT Pub. No.: WO2009/061204

PCT Pub. Date: May 14, 2009

(65) Prior Publication Data

US 2010/0213743 A1 Aug. 26, 2010

(30) Foreign Application Priority Data

Oct. 10, 2007 (NO) ..... 2007 5182

(51) Int. Cl.
*A47C 1/036* (2006.01)
*A47C 1/032* (2006.01)

(52) U.S. Cl. ..... 297/61; 297/342

(58) Field of Classification Search ..... 297/61, 297/342, 284.4
See application file for complete search history.

(56) References Cited

U.S. PATENT DOCUMENTS

| | | | | |
|---|---|---|---|---|
| 4,040,661 | A * | 8/1977 | Hogan et al. | 297/284.4 |
| 4,830,429 | A * | 5/1989 | Petitjean | 297/284.4 |
| 5,472,261 | A | 12/1995 | Oplenskdal et al. | |
| 6,517,156 | B1 | 2/2003 | Lin | |
| 6,923,503 | B2 * | 8/2005 | Sangiorgio | 297/342 |
| 7,422,287 | B2 * | 9/2008 | Heidmann et al. | 297/354.1 |

FOREIGN PATENT DOCUMENTS

| | | | |
|---|---|---|---|
| NO | 310958 | B1 | 9/2001 |
| NO | 313783 | B1 | 12/2002 |
| NO | 314563 | B1 | 4/2003 |
| NO | 328012 | B1 | 11/2009 |
| WO | WO 92/06621 | A1 | 4/1992 |

* cited by examiner

*Primary Examiner* — Milton Nelson, Jr.
(74) *Attorney, Agent, or Firm* — Birch, Stewart, Kolasch & Birch, LLP

(57) ABSTRACT

Device for a reclining chair or functional sofa with an adjustable back support and an adjustable headrest, where the device when the back support is moved is adjusted to influence the headrest angle relative to the back support in such a way that the headrest is rotated from an almost vertical plane to an angle in relation to the back support when the back support is reclined, while at least one rotatable joint in between the headrest and the back support is connected with at least one frictional part by the use of at least one strut in such a way that a user with his/her head or other force can rotate the headrest backwards or forward as so desired when the back support is in desired reclined position.

7 Claims, 5 Drawing Sheets

Fig. 2
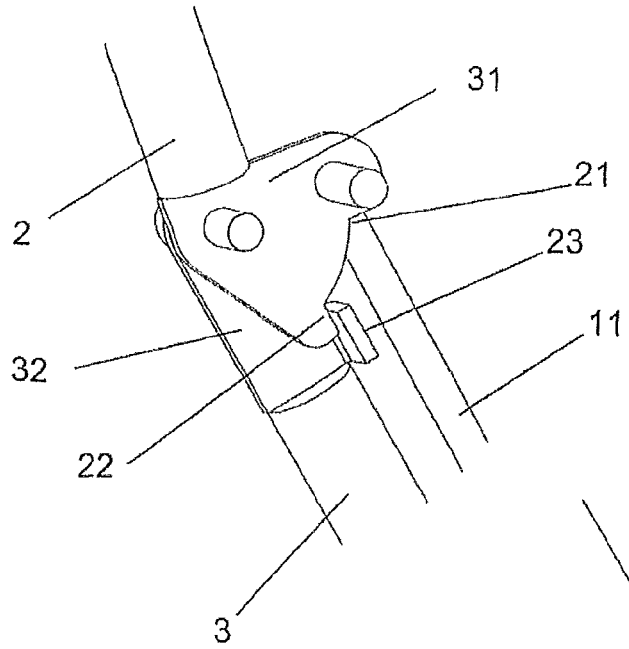
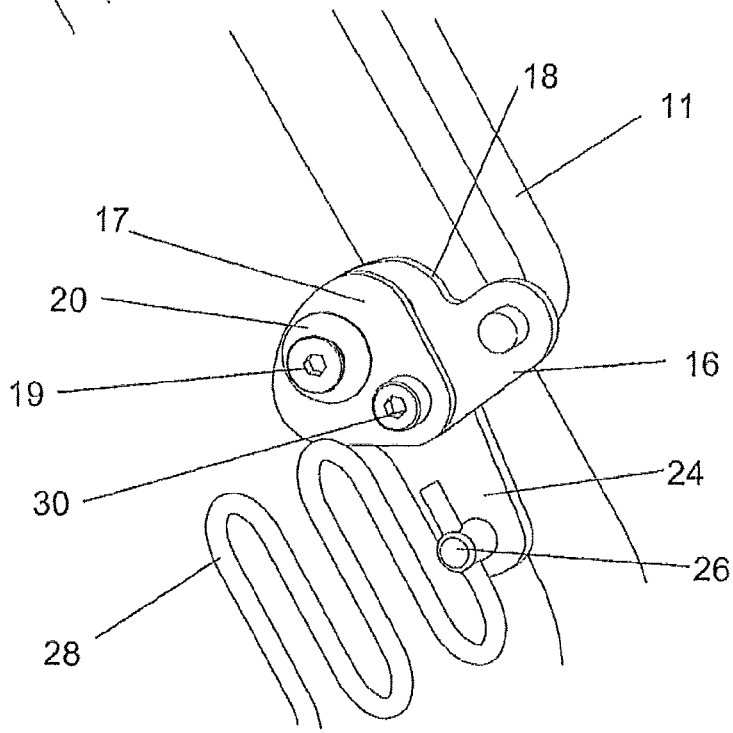
Fig. 3

DEVICE FOR A RECLINING CHAIR

BACKGROUND OF THE INVENTION

1. Field of the Invention

The present invention relates to a device for a reclining chair, according to the preamble of claim 1.

2. Description of Background Art

There is a number of reclining chairs/functional sofas on the marked which, by using different systems, can be adjusted from sitting to lying position. For many of these reclining chairs/functional sofas, it is typical that they have a linkage between the seat- and back-section. This linkage leads to that some of the models have back sections which can rotate about a transversal axes that passes through these linkages between the seat- and back-section. For reclining chairs/functional sofas intended for private use, the back section normally rotates about a stationary axis somewhere higher up on the back section. This axis is normally placed at the same height as the elbow for a person sitting straight up in the chair.

It is important for a reclining chair/functional sofa to give the most comfortable resting position for a user as possible and in this connection it is important that the back of the user get a support which is as good as possible in all reclining positions of the chair. When a person is sitting straight up the back will have an S-shape while when it is reclined backwards the back will have a more straight and stretched shape. When the back has a S-shape, it is ergonomically correct that the chair give support to the lower back and at the neck while the support shall be more evenly positioned when a person is reclined backwards or is "lying".

There are a number of known solutions for changing the form of the back section to a reclining chair. Some of these are manual where the user adjust these according to his/hers own wishes during or before use. The disadvantage with manual solutions are that by changing the sitting position the need to change these manual adjustments will increase to maintain the comfort of using the chair.

For those reclining chair solutions where there are no possibilities for adjustment, the lower back support is fixed for upright sitting position and will thus often be too dominating and unpleasant when the reclining chair is in its reclining position. This means that the lower back support will be more and more noticeable and unpleasant as the back section is reclined. Another solution is that one make use of the upholstery which will give sufficient support at an upright position and that the upholstery will be stretched to reduce the support when in declined position. However, the use of extra support in the upholstery often give a limited effect with regards to what type of upholstery can be used and what of fabric is used to protect it. Another disadvantage is the appearance of the reclining chair which, with the solution described above, often give a wrinkled surface at the lower back section in upright position. For those solutions which are semiautomatic or fully automatic, the mechanisms are often large in size and thus give limitations in the shape and choice of fabric for the upholstery on the back section.

References are made to Norwegian patent application NO 1999 1983; Norwegian patent 176 384, 313 783 and 314 563; and International Application WO 92/006621.

SUMMARY OF THE INVENTION

It is therefore the objective of the present invention to solve the need for features in a reclining chair/functional sofa that is maintenance free and that the user does not need to relate to (automatic). These solutions are normally designed to increase the comfort for the user in the reclining chair/functional sofa. This is achieved with the device according to the present invention as it is defined in the characterizing part of the independent claims.

BRIEF DESCRIPTION OF THE DRAWINGS

The invention will be described in more detail in the following in connection with some design examples and with references to the drawings, wherein:

FIG. 2 shows a detail picture of the joint between the upper back and the neck support;

FIG. 3 shows a detail picture of the frictional joint;

DETAILED DESCRIPTION OF THE DRAWINGS

Figure 4:
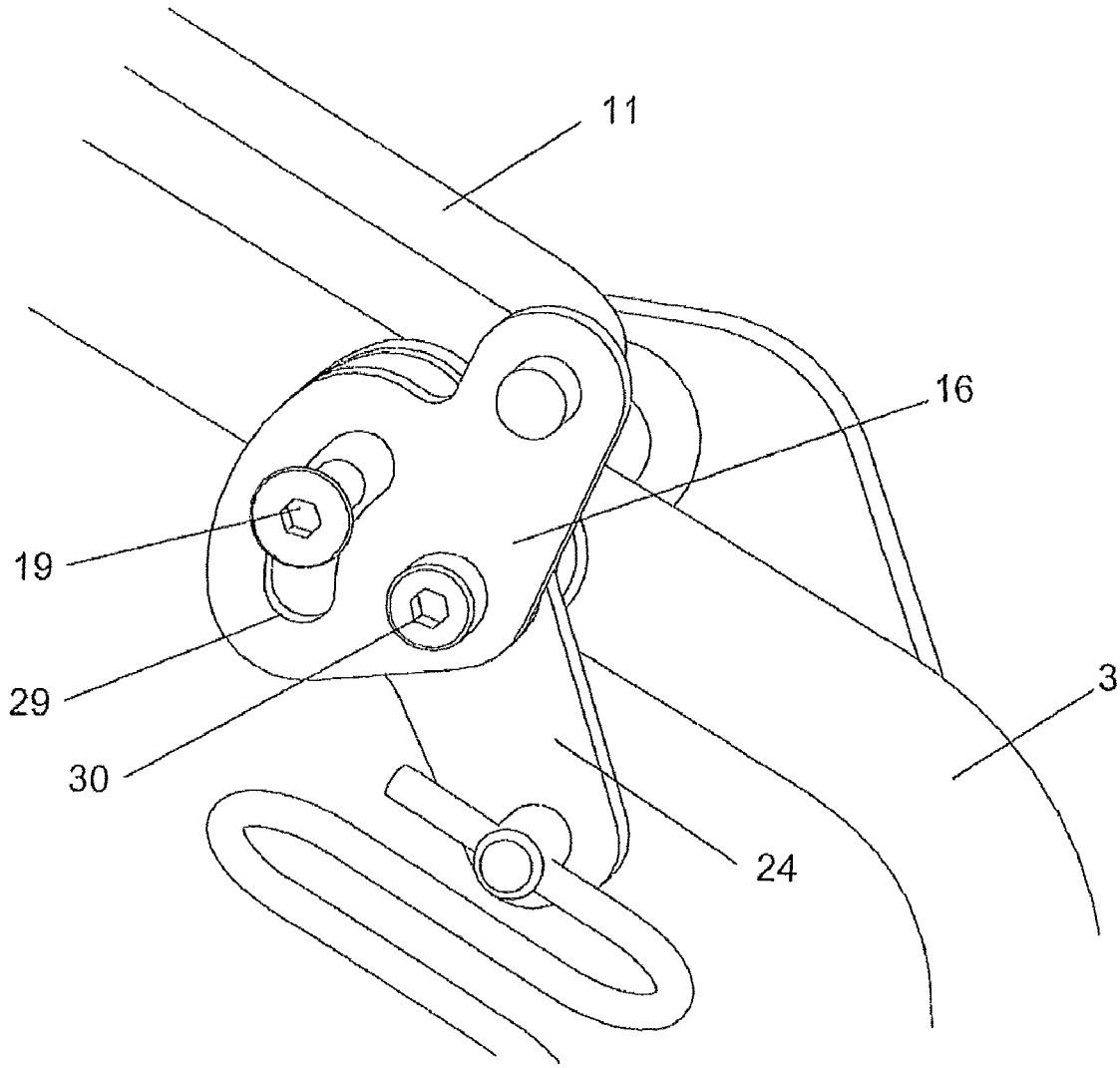
FIG. 4 shows details of the frictional arm.
Figure 5:
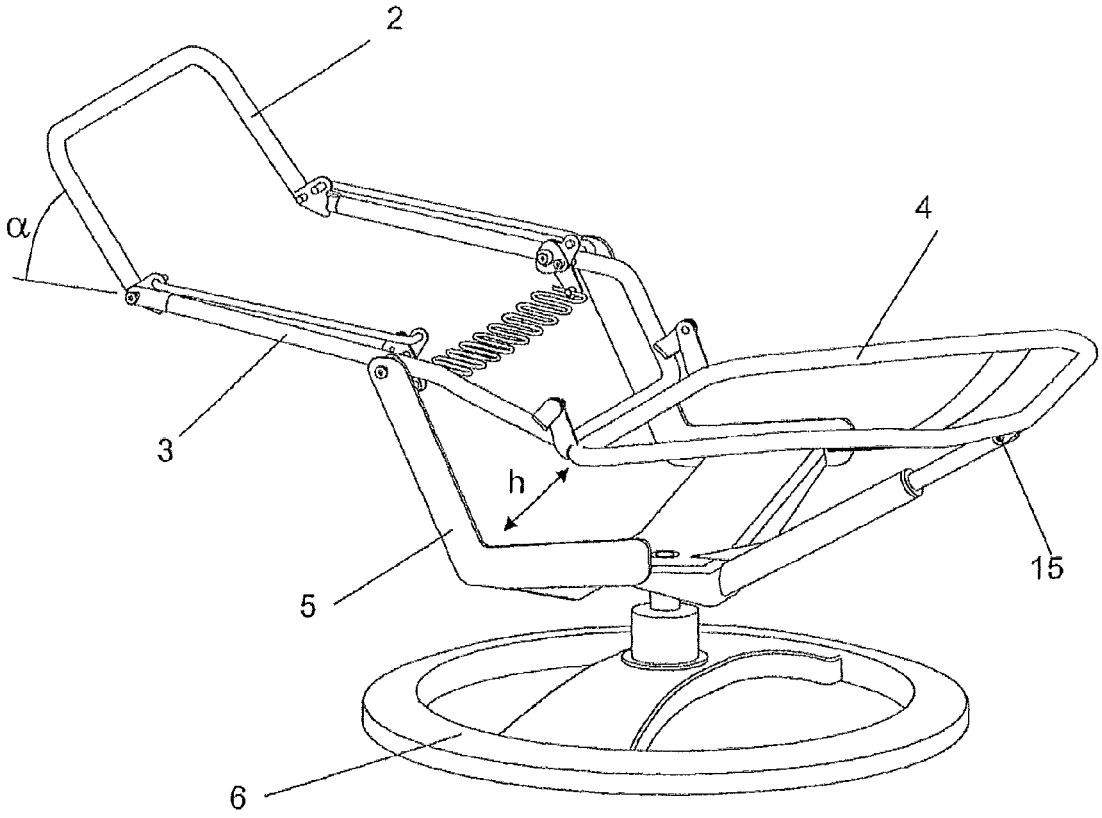
FIG. 5 shows the reclining chair reclined with the neck support angled maximum forward.

The invention is in this application symmetrical and thus the same parts will be found on both sides of the reclining chair, and thus the FIGS. 3, 4 and 5 show details of only one side.

With reference to FIGS. 1-4. A reclining chair 1 comprise of a headrest 2, a back support 3 where the headrest 2 is connected to the back support 3 with at least one rotational joint 7, 8, a seat part 4 which is connected to the back support 3 through at least one joint 9, 10, a frame part 5 and a support part 6. The frame part 5 supports "the chair part" through a horizontal axis of rotation A-A which passes through the back support 3 and at least one guide 15 which is rotatably fixed to the foremost part of the seat part 4.

The invention can be mounted in a reclining chair or a functional sofa, as shown on the figures, and it functions by letting the reclining chair 1 create a shape along the body and that one in addition can adjust the headrest 2 individually. The reclining chair 1 which is shown in the figures is of the type where the back support 3 rotates about a horizontal axel A-A which often is placed in the height of the elbow when the user is sitting upright, but can also be used on other types of reclining chairs/functional sofa, hereafter called reclining chairs. The invention is narrow and simple along upper part of the back support, while the more robust functional part is placed by the axes of rotation A-A in such a way that the upholstery for the back support can be made thinner if so wished, without loosing functionality.

The invention comprise at least one rotational joint 7, 8 between the headrest 2 and the back support 3, at least one frictional part 13, 14 which is placed at the axis of rotation A-A to the back support 3, and at least one strut 11, 12 which connects the rotational joint 7,8 with the frictional part 13, 14.

The frictional part 13, 14 comprise a frictional arm 16 which is rotatably fixed in a point 30 and between at least a frictional washer 17, 18 and the frame 5 by the use of at tightening device 30 with a washer, plate, or similar 20. The frictional arm rotates about the axes A-A which goes through the point 30. A tightening device 19 is fixed to the frictional part a bit away from the rotating axis A-A.

Further more the invention comprise at least one arm 24, 25 which is none rotatably fixed to the frame part 5, where the arm 24, 25 extends from the axis of rotation A-A downwards toward the seat part 4 when the reclining chair is in upright position. Between the arms 24, 25 it is positioned a spring/ band/strap or similar 28, which is rotatably fixed 26, 27 to the lower end of the arms 24, 25 in such a way that it can rotate around its own horizontal axis of rotation and which give lower back support.

The at least one rotatable joint 7, 8 comprise a flat triangular shaped plate fixed to the headrest 2, a nearly rectangular plate fixed to the back support 3 and a fixing device which allow these two plates to rotate. The flat triangular shaped plate is supplied with two extensions, in the direction of the plate, where each provides a support surface 21, 22. The support surfaces are placed on a common arc in the same plane as the triangular shaped plate and where the fixing device for the plate is the centre for the arc. These support surfaces 21, 22 comes in contact with at least one stop 23 which is placed inbetween the support surfaces 21, 22 and fixed to the back support 3 adjacent to the rotational joint 7,8. The stop 23 together with the support surfaces 21, 22 ensures that the headrest 2 only can rotate within a predetermined angle relative to the back support 3.

In upright position the headrest 2 will preferably have an almost vertical position relative to a horizontal line which can rotate around the axis of rotation A-A. When the upper back support 3 is reclined, the friction in the friction part 13, 14 will be sufficient to prevent the strut 11, 12 which leads to the rotational joint 7, 8, to move and thus will maintain the angle of the headrest 2 from the upright position so that the headrest 2 will rotate in the rotational joint 7, 8 while the back support 3 is reclining. Thus the headrest 2 will be pushed forward towards the back of the head of the user relatively, as the back support 3 is reclining. The user can adjust headrest 2 all the time manually more backwards, but not necessarily forward. If the frictional part 13, 14 is premounted in such a way that the tightening device 19 rests towards an outer limitation 29 in the frictional part in upright position. If the frictional part is premounted with a distance between the point 19 and an outer limitation 29, it will be possible to move the headrest 2 limited forward. The tightening device 19 can e.g. be a screw, bolt, a pin, sleeve, etc.

The above scenario will go on until the rotational joint 7, 8 has rotated sufficiently so that the support surface 21 get in contact with the stop 23 on the back support 3. If the back support 3 is reclined further, the frictional arm 16 will now start to rotate around a point 30 due to strut 11, 12, which is between the rotational joint 7, 8 and the frictional part 13, 14, will pull the friction arm 16 with it. From this position and further reclining, the headrest 2 will be able to move both backwards and limited forward due to that the stop function in the frictional part 13, 14, until maximum movement for headrest 2 is achieved due to the stop function in the frictional part 13, 14 do not get in contact and the rotation of the headrest is only limited by the contact surfaces 21, 22 coming in contact with the stop 23.

When the back support 3 is moved back to upright position, the friction in the friction part 13, 14 will be sufficient to prevent the friction arm 16 to rotate and the head rest 2 will keep its angle and a rotation in the rotational joint 7, 8 will occur. This will be maintained until the support surface 22 in the rotational joint 7, 8 comes in contact with the stop 23 and stops further rotation in the rotational joint 7, 8 and the friction arm 16 will now be pushed by the help of the strut 11, 12 back to the initial starting point in upright position. In upright position the stop function for frictional arm 16 will be re-established and the headrest 2 will not or only limited be adjustable forward or backwards since the support surface 22 is in contact with or almost in contact with the stop 23.

The lower back support 28 is in this example a Nozag spring. The length of the arms 24, 25 is partly given by "the placement" of the lower back relative to the seat part 4 for a user in a reclining chair, to give optimal lower back support. When the lower part of the back support 3 is moved forward and upwards, at same moment as the upper part of the back support 3 is reclined, there will be a relative movement between the lower back support 28 and the lower part of the back support 3, since the lower back support 28 only rotates around its own axis of rotation and do not move in relation to the frame 5. For the user this will feel like, due to the relative movement to the lower part of the back support 3, as a continuous and gradually reduction of the lower back support 28 during the whole reclining of the back support 3 and makes the use of the reclining chair 1 very comfortable and ergonomically correct. In a similar manner the lower back support 28 will continuously and gradually increase when the back support 3 is pulled up towards a upright position.

Figure 1:
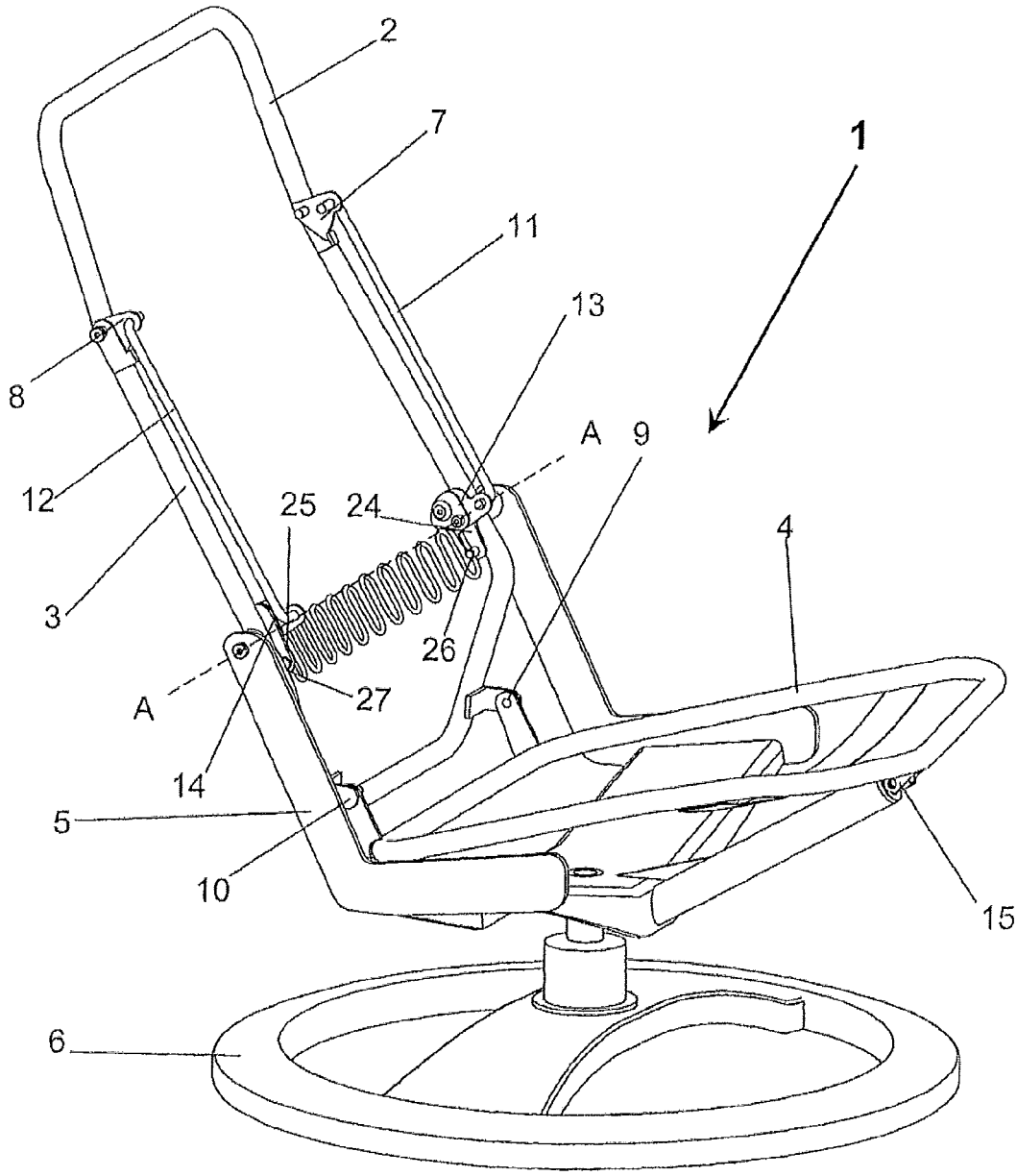
FIG. 1 shows the framework of a reclining chair in which the invention is used.
Figure 6:
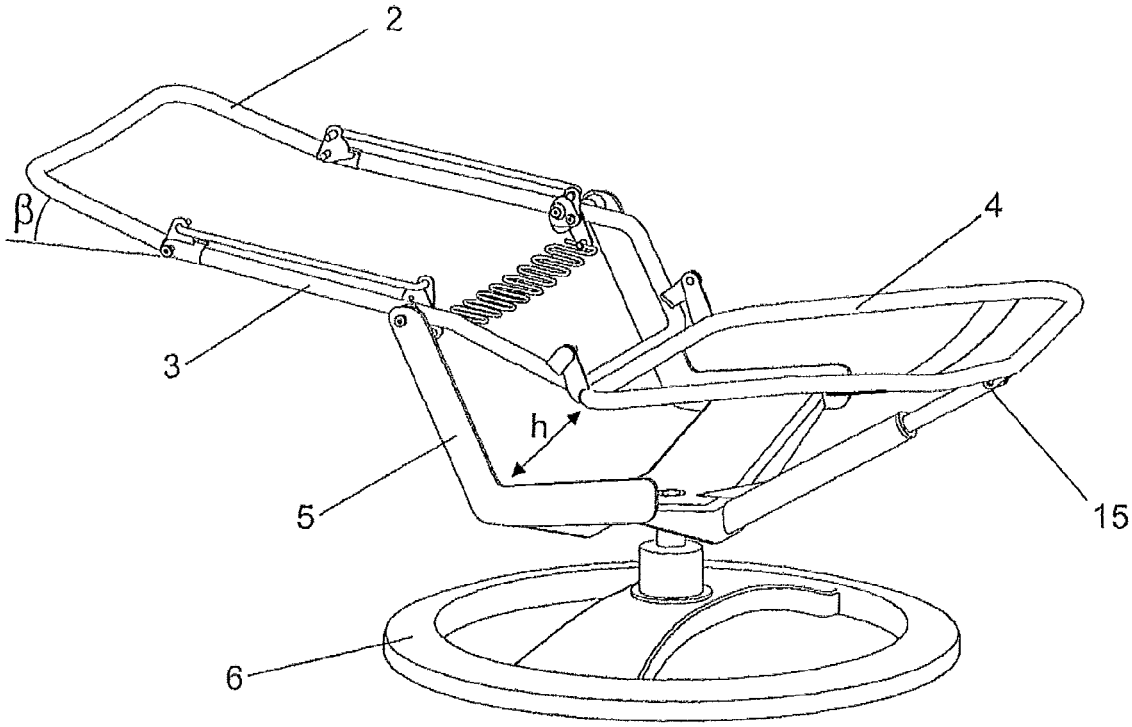
FIG. 6 shows a reclining chair reclined with the neck support pushed maximum backwards.

The FIGS. 5 and 6 show how the seat part 4 is elevated upwards a distance h from the frame part 5 when the back support 3 is reclined, compared to the position of the seat part 4 in FIG. 1. In FIG. 5 the headrest 2 is in the position the headrest 2 will take if the user do not provide pressure towards the headrest 2, but only provides pressure towards the back support 3. The headrest 2 will then have a maximum displacement forward and the support surface 21 in the rotational joint 7, 8 would rest against the stop 23 and prevent further rotation forward. The angle $\alpha$ represent the largest angle the headrest 2 can get in relation to the back support 3. In FIG. 6 the headrest 2 is pushed as far backwards as possible until the support surface 22 in the rotational joint 7, 8 comes in contact with the stop 23 and prevents further rotation backwards. The angle $\beta$ represents the smallest angle the headrest can get in relation to the back support 3.

The invention claimed is:

1. A reclining chair or functional sofa comprising:

a back support;

a seat part;

a headrest;

a lower back support;

a frame part, wherein the back support is rotatable around a stationary and horizontal axis relative to the frame part;

a support part;

a connection joint structurally configured to connect a lower end of the back support with the seat part;

a guide structurally configured to cooperate with the connection joint to displace the seat part forward and backward relative to the frame part when the back support rotates forward or backward; and two arms fixed to the frame part and extending downward from the stationary horizontal axis toward the lower end of the back support when the back support is in an upright position, each of the two arms being shorter than a distance from the horizontal axis to the lower end of the back support, wherein the lower back support is rotatably fixed between lower parts of the arms, and wherein an angle between the arms and the back support is small when the back support is in the upright position, whereby the lower back support provides a distinct lower back support to a user, and the angle is configured to gradually increase as the back support rotates backward and moves the lower part of the back support away from the lower back support, whereby the distinct lower back support provided to the user gradually decreases as the back support rotates backward from the upright position.

2. The reclining chair according to claim 1, wherein the lower back support comprise a spring, a band or a strap.

3. The reclining chair according to claim 1, further comprising a regulating device, said regulating device comprising:

a rotational joint comprising:

a first plate fixed to the headrest;

a second plate fixed to the back support, wherein the first and second plates are rotatable relative to each other about a rotational joint axis, and the first plate has two support surfaces extending parallel to, and in separate radial directions from, the rotational joint axis;

a rotatable fixture structurally configured to provide a first friction force between the first and the second plate; and a stop mounted on the back support between the two support surfaces;

frictional parts comprising:

a frictional arm rotatable relative to the frame part about the stationary and horizontal axis;

at least one frictional washer engaging the frictional arm; and at least one tightening device disposed through the frictional arm and the at least one frictional washer at a distance from the stationary and horizontal axis, the at least one tightening device being configured to provide a second friction force which is greater than the first friction force; and at least one strut rigidly connecting an extension of the first plate with a distal end of the friction arm, the extension of the first plate providing a lever arm from the rotational joint axis, wherein the regulating device is structurally configured so that rotating the back support causes a rotation of the first plate and the headrest via the second friction force.

4. The reclining chair according to claim 3, wherein the rotation of the headrest relative to the back support is limited by the support surfaces engaging the stop, whereby the angle between the two support surfaces defines a possible range of angles between the headrest and the back support.

5. The reclining chair according to claim 3, wherein the lower back support comprise a spring, a band or a strap.

6. The reclining chair according to claim 3, wherein the rotation of the frictional arm is limited by stopping elements in the frictional parts.

7. The reclining chair according to claim 6, wherein the stopping elements comprise the tightening device disposed in a curved slot with an outer limitation.

* * * * *